US011720057B2

(12) United States Patent
Yuzawa et al.

(10) Patent No.: US 11,720,057 B2
(45) Date of Patent: Aug. 8, 2023

(54) IMAGE FORMING APPARATUS

(71) Applicant: CANON KABUSHIKI KAISHA, Tokyo (JP)

(72) Inventors: Atsuyuki Yuzawa, Kanagawa (JP); Yu Shuhama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/521,550

(22) Filed: Nov. 8, 2021

(65) Prior Publication Data

US 2022/0057748 A1 Feb. 24, 2022

Related U.S. Application Data

(62) Division of application No. 17/038,128, filed on Sep. 30, 2020, now Pat. No. 11,199,810.

(30) Foreign Application Priority Data

Oct. 1, 2019 (JP) ..... 2019-181251

(51) Int. Cl.
*G03G 21/20* (2006.01)

(52) U.S. Cl.
CPC ..... *G03G 21/206* (2013.01)

(58) Field of Classification Search
CPC ..... G03G 21/206; G03G 21/1619; G03G 2221/1645; G03G 2221/1678
See application file for complete search history.

(56) References Cited

U.S. PATENT DOCUMENTS

| | | | | |
|---|---|---|---|---|
| 6,736,392 | B1 | 5/2004 | Horiguchi et al. | B65H 31/02 |
| 11,199,810 | B2 * | 12/2021 | Yuzawa | G03G 21/206 |
| 2007/0146739 | A1 * | 6/2007 | Igarashi | G03G 21/206 358/1.7 |
| 2008/0050145 | A1 | 2/2008 | Hanano | G03G 21/20 |

(Continued)

FOREIGN PATENT DOCUMENTS

| | | |
|---|---|---|
| JP | H06-188581 | 7/1994 |
| JP | H11-161135 | 6/1999 |

(Continued)

OTHER PUBLICATIONS

Office Action dated Jun. 27, 2023 in counterpart Japanese Application No. 2019-181251, together with English translation thereof.

*Primary Examiner* — Thomas S Giampaolo, II
(74) *Attorney, Agent, or Firm* — Venable LLP

(57) ABSTRACT

An image forming apparatus includes an air communication port, and an outer casing covering an outside of a frame member of the image forming apparatus. The outer casing includes a first side surface facing in one of a first direction and a second side surface facing in one of a second direction perpendicular to the first direction. The first side surface includes a first surface portion extending in a vertical direction, a second surface portion offset in the first direction from the first surface portion toward the inside of the image forming apparatus, and a third surface portion connecting the first and second surface portions. The third surface portion is provided with the air communication port penetrating the outer casing. The first, second surface and third surface portions extend to the second side surface.

8 Claims, 8 Drawing Sheets

(56) References Cited

U.S. PATENT DOCUMENTS

| | | | | |
|---|---|---|---|---|
| 2009/0285588 | A1* | 11/2009 | Furuichi | G03G 21/206 399/27 |
| 2011/0280609 | A1* | 11/2011 | Nakazawa | G03G 21/206 399/92 |
| 2016/0246247 | A1 | 8/2016 | Tamura et al. | G03G 15/00 |
| 2017/0336758 | A1 | 11/2017 | Watanabe | G03G 21/20 |
| 2021/0096511 | A1 | 4/2021 | Okawa et al. | G03G 21/1619 |

FOREIGN PATENT DOCUMENTS

| | | |
|---|---|---|
| JP | 2008-20809 | 1/2008 |
| JP | 2008-077077 | 4/2008 |
| JP | 2016-1566876 | 9/2016 |
| JP | 2017-211407 | 11/2017 |

* cited by examiner (a)

(b)

IMAGE FORMING APPARATUS

This application is a division of application Ser. No. 17/038,128 filed Sep. 30, 2020, currently pending; and claims priority under 35 U.S.C. § 119 to Japan Application No. 2019-181251 filed in Japan on Oct. 1, 2019; and the contents of all of which are incorporated herein by reference as if set forth in full.

FIELD OF THE INVENTION AND RELATED ART

The present invention relates to an image forming apparatus such as a copying machine, a printer or a facsimile machine.

In a conventional image forming apparatus, a side surface of the image forming apparatus is provided with an air communication port. By sucking the air of an outside of the image forming apparatus through the air communication port provided in the side surface of the image forming apparatus and by discharging the air of an inside of the image forming apparatus through the air communication port, cooling of a heat generating member (element) provided inside the image forming apparatus is realized.

The above-described conventional image forming apparatus is provided with a rib projecting from the side surface of the image forming apparatus so that the air communication port provided in the side surface of the image forming apparatus is not blocked (closed) by a wall surface when the image forming apparatus is placed against a wall. By this, even when the image forming apparatus is placed against the wall, the rib projecting from the side surface of the image forming apparatus contacts the wall surface, so that it is possible to ensure an air communication passage, through which the air is capable of passing, between the air communication port provided in the side surface and the wall surface.

However, the rib projects outward from the side surface, and therefore, there is a problem such that a size of the image forming apparatus is increased. Further, there is a problem such that a projected portion is formed on the side surface of an outer casing of the image forming apparatus by the rib, and therefore, a design property is lowered.

Further, an image forming apparatus in which a grip portion recessed toward an inside of a casing is provided as a part of a side surface of the casing has been proposed (Japanese Laid-Open Patent Application 2008-20809). An upper surface portion of this grip portion is provided with an air communication port for establishing air communication between an inside and an outside of the casing.

In this constitution, the upper surface portion of the grip portion recessed toward the inside of the casing of the image forming apparatus is provided with the air communication port. For that reason, even when the image forming apparatus is placed against a wall, a space can be ensured between the air communication port and a wall surface without providing the above-described rib (projected portion), so that the design property is not lowered. However, the constitution in which the grip portion is provided as the part of the side surface of the image forming apparatus is employed. For that reason, when the image forming apparatus is placed against the wall, the grip portion is covered with the wall surface, so that there is a problem such that although the space can be ensured between the air communication port and the wall surface, an air communication passage through which the air is capable of passing cannot be ensured.

SUMMARY OF THE INVENTION

A principal object of the present invention is to provide an image forming apparatus capable of ensuring an air communication passage toward an air communication port even when the image forming apparatus is provided against a wall, while preventing upsizing of the image forming apparatus and a lowering in design property.

According to an aspect of the present invention, there is provided an image forming apparatus comprising: an air communication port configured to suck air into the image forming apparatus and to discharge the air from an inside of the image forming apparatus; and an outer casing covering an outside of a frame member of the image forming apparatus, wherein the outer casing includes a first side surface facing in one of a first direction in a horizontal plane and a second side surface facing in one of a second direction perpendicular to the first direction in the horizontal plane, wherein the first side surface includes a first surface portion extending in a vertical direction, a second surface portion offset in the first direction from the first surface portion toward the inside of the image forming apparatus, and a third surface portion connecting the first surface portion and the second surface portion, wherein the third surface portion is provided with the air communication port penetrating the outer casing, and wherein the first surface portion, the second surface portion and the third surface portion extend to the second side surface portion.

Further features of the present invention will become apparent from the following description of exemplary embodiments with reference to the attached drawings.

Figure 2:
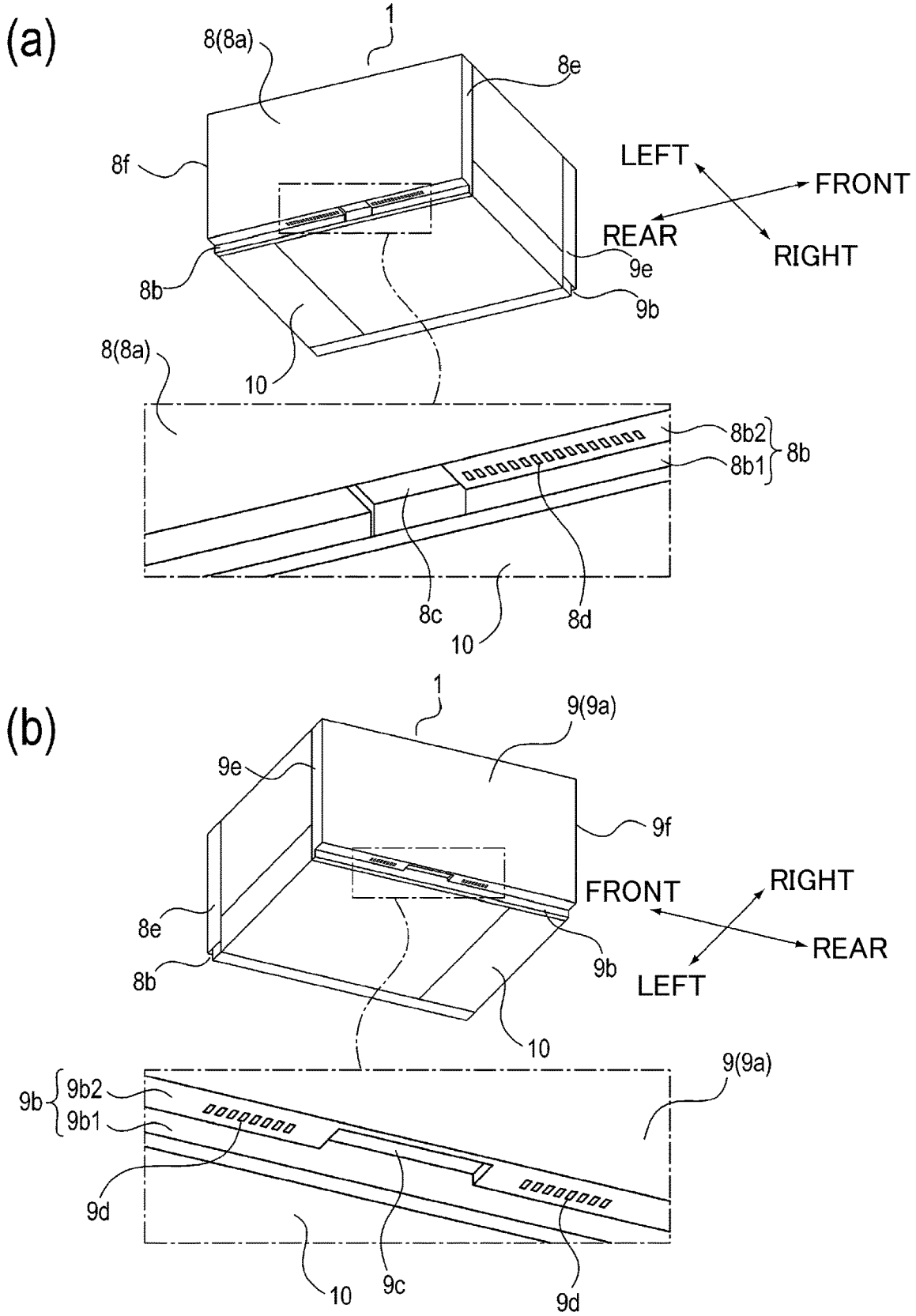

Parts (a) and (b) of FIG. 2 are perspective views showing the image forming apparatus as seen from a bottom of the image forming apparatus.

Figure 3:
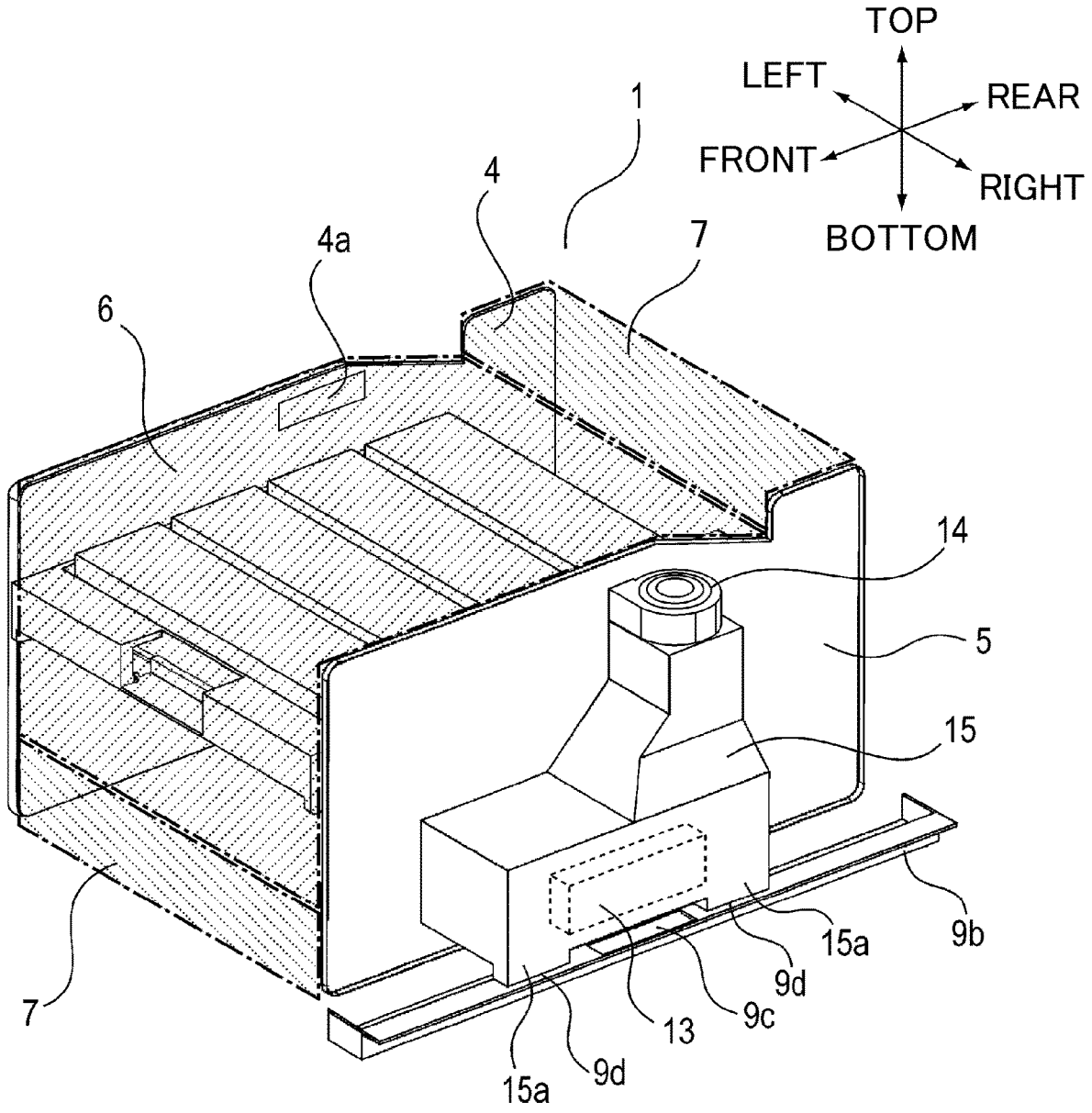

FIG. 3 is a perspective view of the image forming apparatus in which ha portion other than an offset portion of an outer casing cover is indicated by a hatched dotted line.

Figure 1:
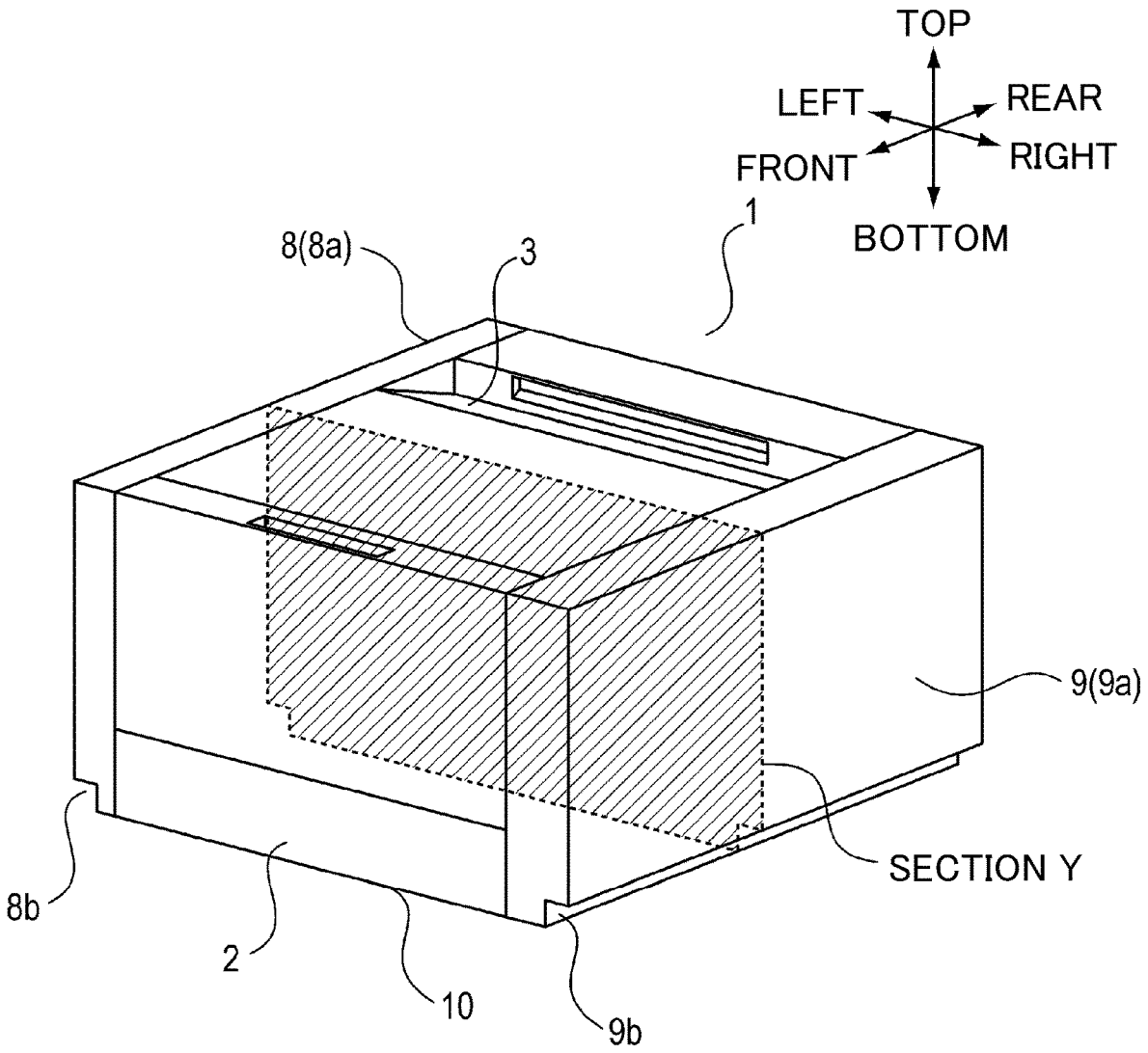
FIG. 1 is a perspective view of an image forming apparatus according to an embodiment.
Figure 4:
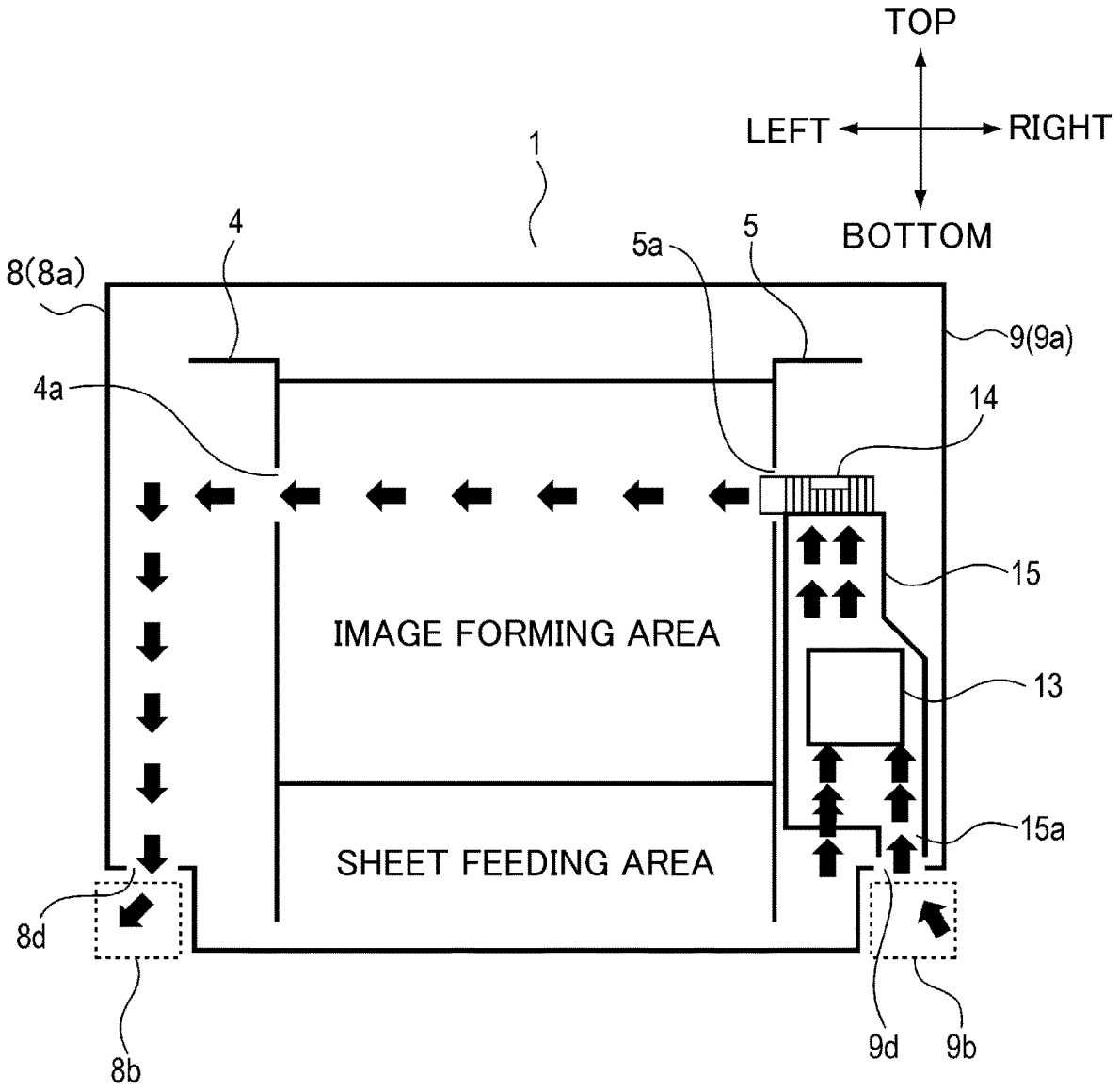

FIG. 4 is a schematic view of the image forming apparatus when a cross section Y with respect to a left-right direction in FIG. 1 is seen from a front (surface) side.

Figure 5:
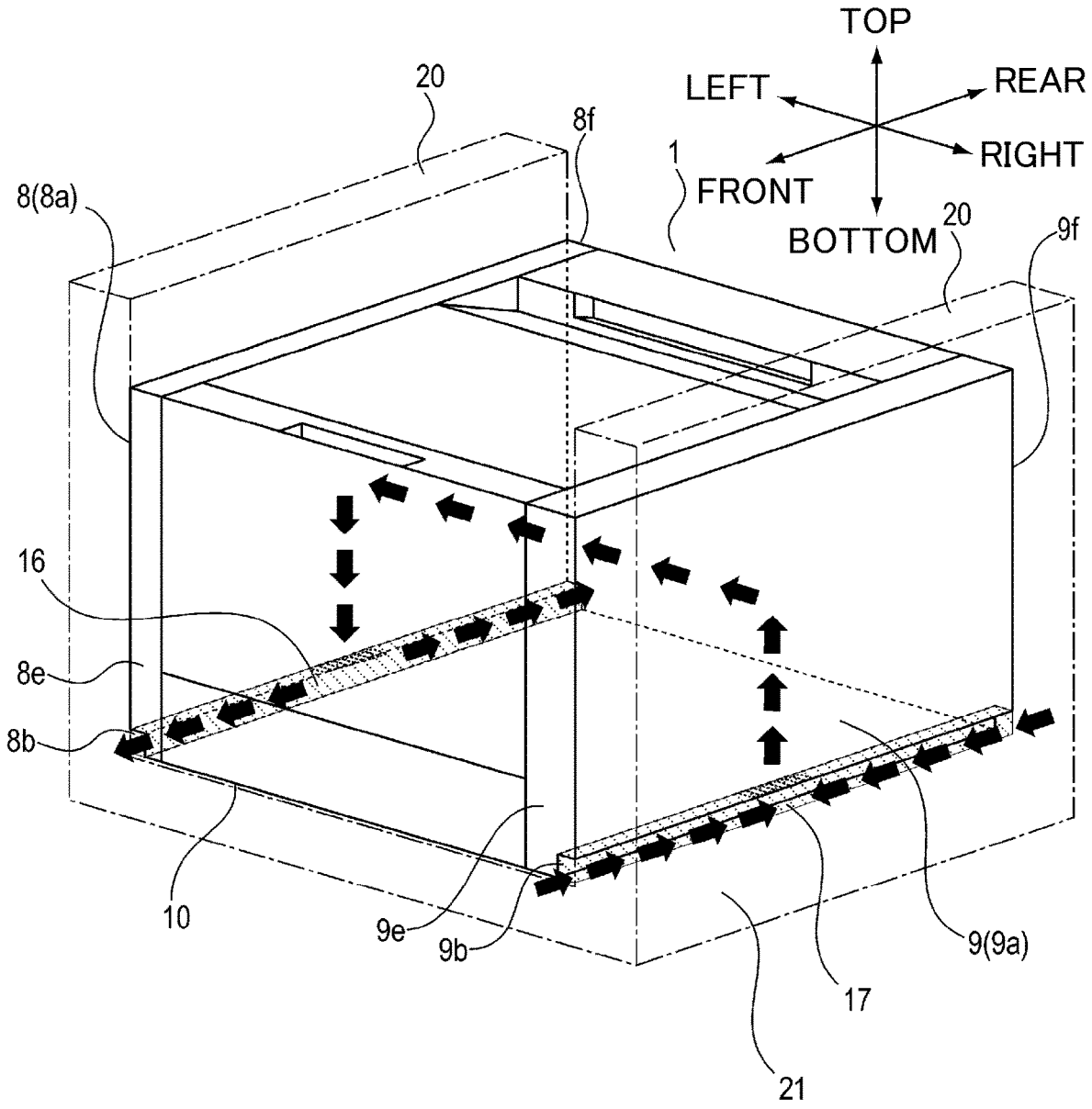

FIG. 5 is a perspective view showing an air passage in the case where the image forming apparatus is provided against a wall.

Figure 6:
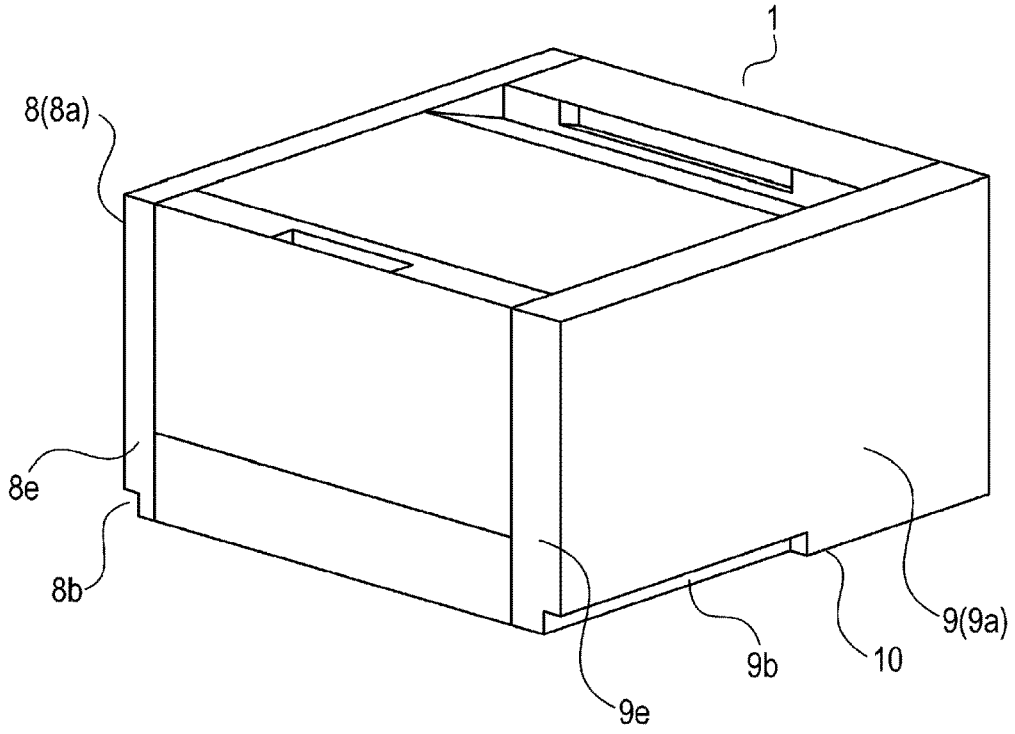
Figure 6:
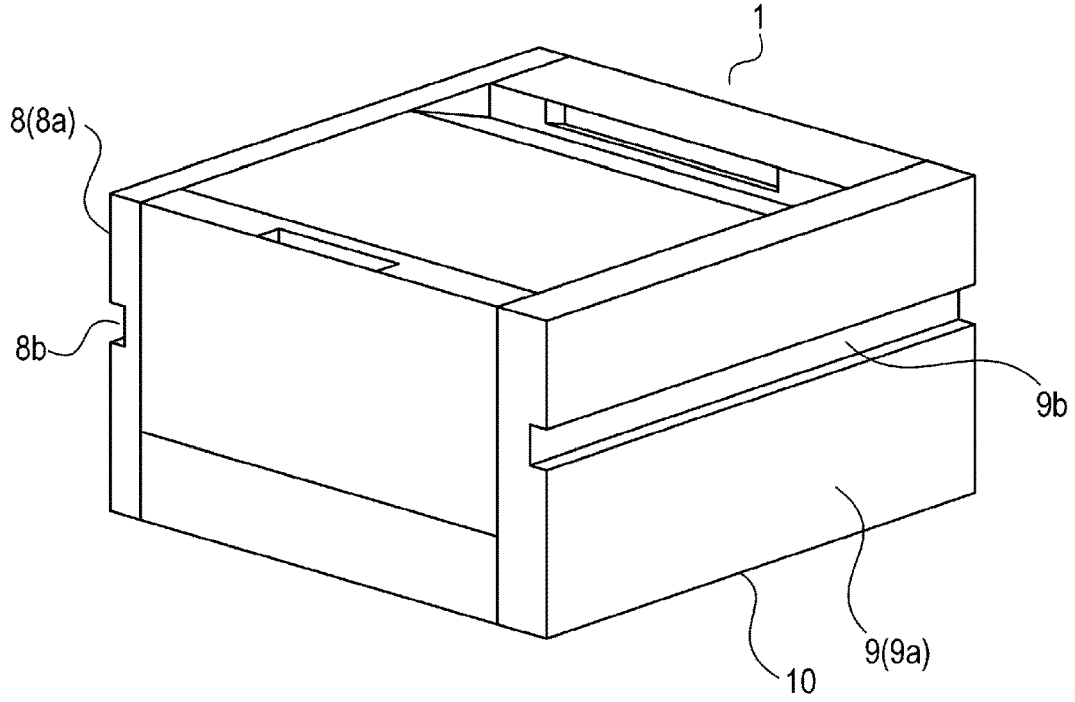

Parts (a) and (b) of FIG. 6 are perspective views each showing an image forming apparatus including an offset portion according to a modified embodiment.

Figure 7:
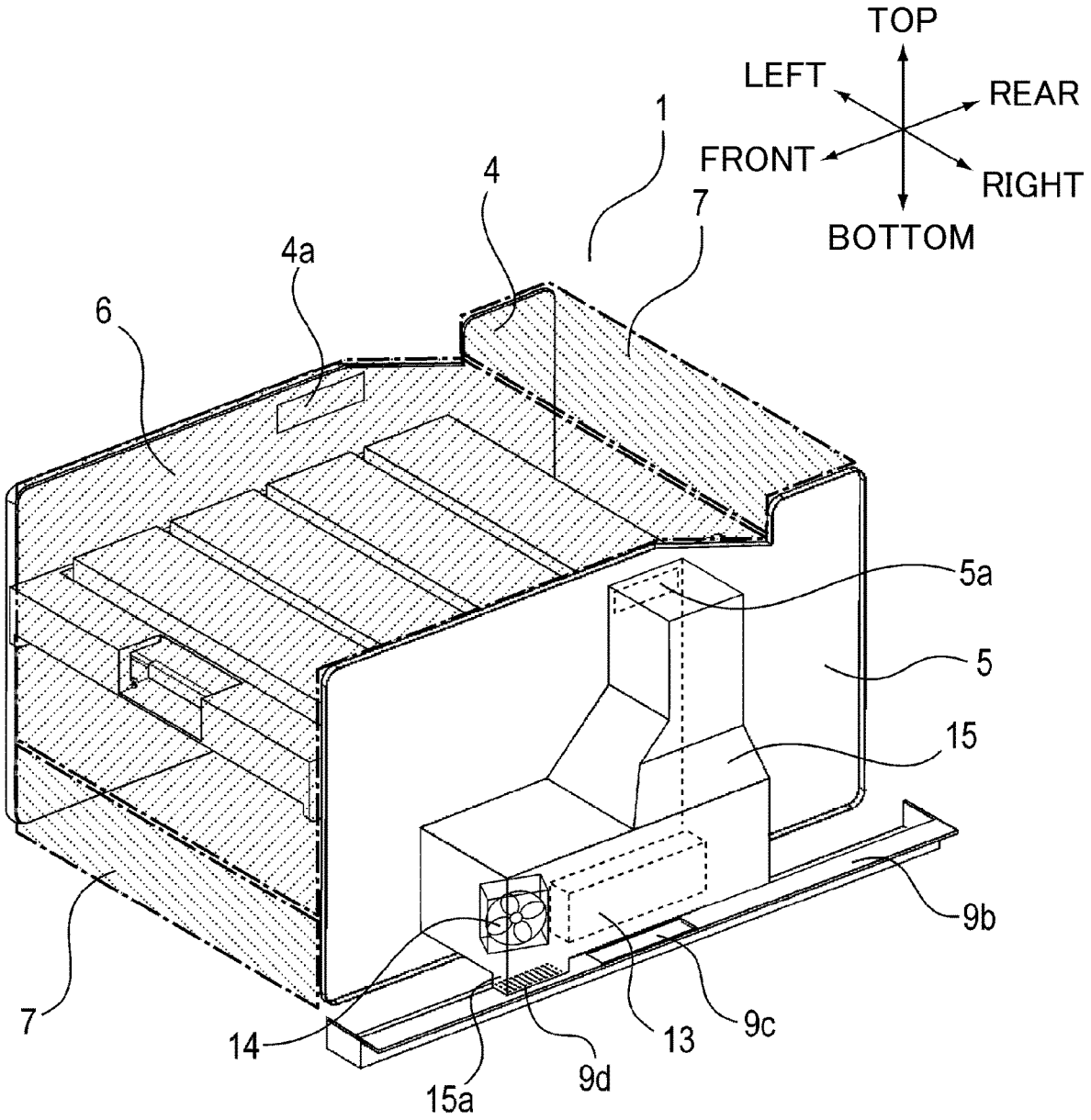

FIG. 7 is a perspective view of an image forming apparatus in which an outer casing other than an offset portion is indicated by a hatched dotted line.

Figure 8:
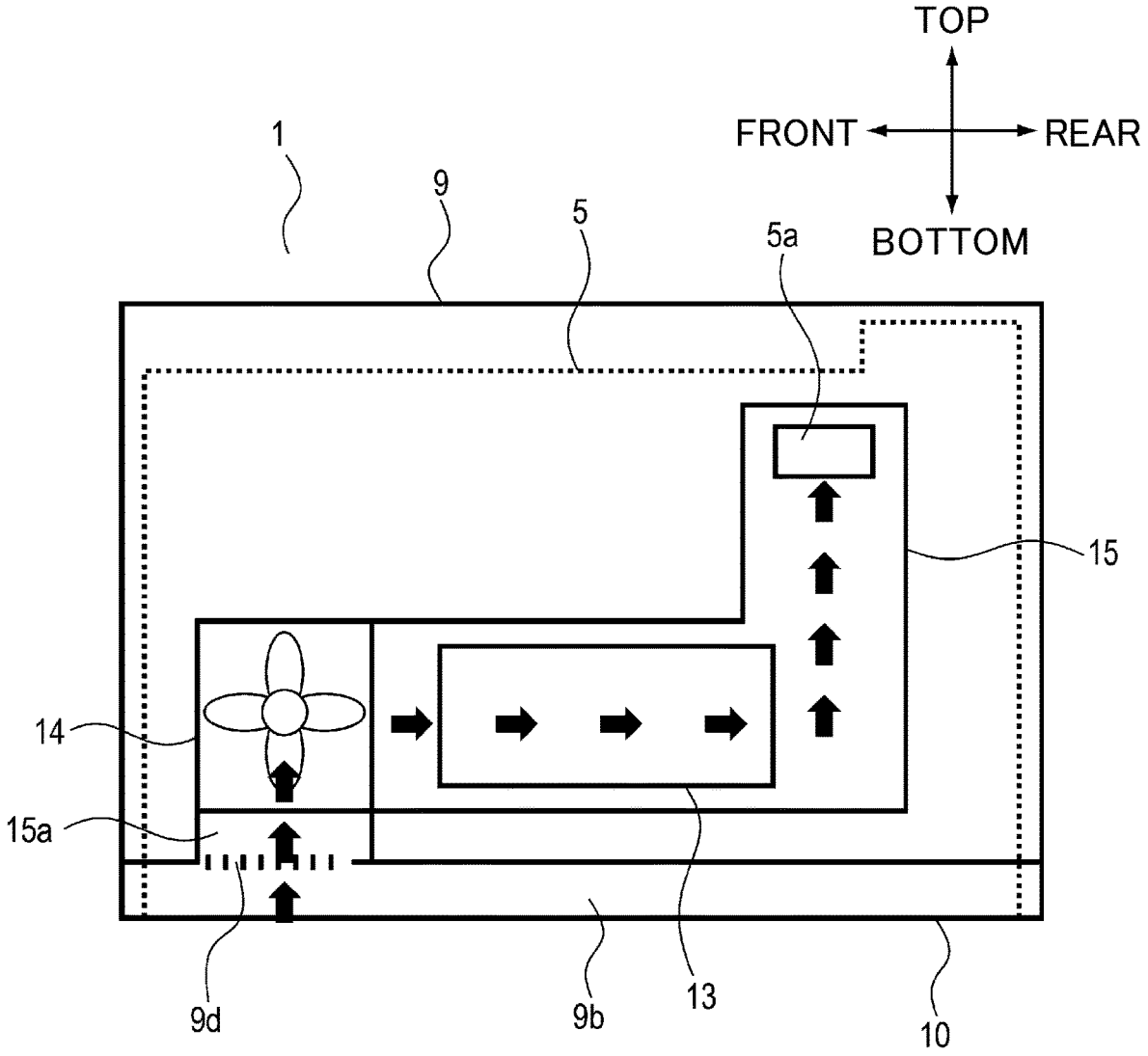

FIG. 8 is a schematic view of an image forming apparatus in a state in which a cross section of the image forming apparatus with respect to a front-rear direction is seen in a right-hand direction.

DESCRIPTION OF THE EMBODIMENTS

In the following, embodiments of an image forming apparatus according to the present invention will be described with reference to the drawings. In the following description, as regards dimensions, materials, shapes and relative arrangement of constituent elements, the scope of the present invention is not intended to be limited to those described below unless otherwise specified.

Embodiment 1

The image forming apparatus according to the present invention will be described using FIGS. 1 to 5. In this embodiment, a printer is illustrated as the image forming apparatus. FIG. 1 is a perspective view of an image forming apparatus 1 according to this embodiment. Part (a) of FIG. 2 is a perspective view of the image forming apparatus 1 as seen from a lower left side, and part (b) of FIG. 2 is a perspective view of the image forming apparatus 1 as seen from a lower right side. FIG. 3 is a perspective view of the image forming apparatus 1 in which a portion other than an offset portion is indicated by a hatched dotted line. FIG. 4 is a schematic view of the image forming apparatus 1 when a cross section Y with respect to a left-right direction in FIG. 1 is seen from a front (surface) side. FIG. 5 is a perspective view showing an air passage in the case where the image forming apparatus 1 is provided against a wall so that left and right side surfaces 8*a* and 9*a* contact wall surfaces 20 and 20.

As shown in FIG. 1, in the image forming apparatus 1, a cassette 2 in which a sheet as a recording material (medium) is stacked and accommodated is mounted so as to be capable of being pulled out. In the image forming apparatus 1, the sheet stacked in the cassette 2 is not illustrated, but is sent to an image forming portion for forming an unfixed image, and then the unfixed (image) is transferred at a transfer portion. The sheet on which the unfixed image is formed is further sent to a downstream side, and the unfixed image is fixed on the sheet at the fixing portion by heat and pressure, so that the sheet is discharged onto a discharge stacking tray 3.

In the following description, with respect to the image forming apparatus 1, a front side (front surface side) refers to a side where the cassette 2 is pulled out of the image forming apparatus 1, and a rear side (rear surface side) refers to a side opposite from the front side. Further, left and right refer to those in the case where the image forming apparatus 1 is seen from the front side. Further, upper and lower refer to those in the case where the image forming apparatus 1 is seen from the front side, and a top surface side refers to an upper side, and a bottom side opposite from the top surface side refers to a lower side.

As shown in FIG. 3, the image forming apparatus 1 includes a right side plate 5 which is a first frame member provided on one side with respect to a left-right direction which is a first direction and includes a left side plate 4 which is a second frame member provided on the other side so as to opposite the right side plate 5 with respect to the first direction. The image forming apparatus 1 includes, between the left side plate 4 and the right side plate 5 which are the frame members and which are made of metal, an image forming area 6 provided in the image forming portion (not shown) and a sheet (paper) feeding area 7 for feeding the sheet. The image forming area 6 between the left side plate 4 and the right side plate 5 is a space in which the image forming portion is provided. The left side plate 4 and the right side plate 5 which are the frame members oppose a placement surface (not shown) on which the image forming apparatus 1 is placed. As shown in FIG. 1, the image forming apparatus 1 includes outer casing covers 8 and 9 covering the side plates 4 and 5, which oppose each other through the space. The outer casing cover 8 which is a second outer casing member is provided so as to cover an outside of the left side plate 4 shown in FIG. 3. The outer casing cover 9 which is a first outer casing member is provided so as to cover an outside of the right side plate 5 shown in FIG. 3.

As shown in part (a) of FIG. 2, the outer casing cover 8 includes a left side surface 8*a* which is a first side surface facing the horizontal surface with respect to one of the first direction (left-right direction), a surface 8*e* which is a second side surface facing the horizontal surface with respect to one of a second direction (front-rear direction) perpendicular to the first direction, and a surface 8*f* which is a third side surface facing the horizontal surface with respect to the other of the second direction. The outer casing cover 8 includes the left side surface (first surface (portion)) 8*a* which is a vertical surface extending in the vertical direction and an offset portion 8*b* including a second surface (portion) 8*b*1 offset in the first direction from the left side surface 8*a* toward an inside of the image forming apparatus 1 and including a third surface (portion) 8*b*2 connecting the first surface 8*a* and the second surface 8*b*1. In this embodiment, the offset portion 8*b* is provided at a bottom of the outer casing cover 8 with respect to the vertical direction. The left side surface 8*a* which is the first surface, and the second surface 8*b*1 and the third surface 8*b*2 are extended to the one surface 8*e* which is the second side surface. Further, the left side surface 8*a* which is the first surface, and the second surface 8*b*1 and the third surface 8*b*2 are extended to the other surface 8*f* which is the third side surface.

The offset portion 8*b* is constituted so that a user holds the offset portion 8*b* with his (her) hand(s) and is capable of raising the image forming apparatus 1. Specifically, as shown in part (a) of FIG. 2, the third surface 8*b*2 of the offset portion 8*b* on an upper side with respect to the vertical direction is provided with a handle portion 8*c* held by the user with his (her) hand(s) when the user raises the image forming apparatus 1. The handle portion 8*c* is a recessed portion recessed upward with respect to the vertical direction at the third surface 8*b*2 of the offset portion 8*b*. Further, the third surface 8*b*2 of the offset portion 8*b* is provided with an air communication port 8*d* penetrating the outer casing cover 8. Each of the left side surface 8*a* which is the first surface, and the second surface 8*b*1 and the third surface 8*b*2 is a flat surface, but at least one surface thereof may only be required to be the flat surface. Of the second surface 8*b*1 and the third surface 8*b*2, the surface where the handle portion 8*c* is provided may preferably be the flat surface.

As shown in part (b) of FIG. 2, the outer casing cover 9 includes a right side surface 9*a* which is a first side surface facing the horizontal surface with respect to the other of the first direction (left-right direction), a surface 9*e* which is a second side surface facing the horizontal surface with respect to one of a second direction (front-rear direction) perpendicular to the first direction, and a surface 9*f* which is a third side surface facing the horizontal surface with respect to the other of the second direction. The outer casing cover 9 includes the right side surface (first surface) 9*a* which is a vertical surface extending in the vertical direction and an offset portion 9*b* including a second surface 9*b*1 offset in the first direction from the right side surface 9*a* toward an inside of the image forming apparatus 1 and including a third surface 9*b*2 connecting the right side surface 9*a* and the second surface 9*b*1. In this embodiment, the offset portion 9*b* is provided at a bottom of the outer casing cover 9 with respect to the vertical direction. The right side surface 9*a* which is the first surface, and the second surface 9*b*1 and the third surface 9b2 are extended to the one surface 9e which is the second side surface. Further, the right side surface 9a which is the first surface, and the second surface 9b1 and the third surface 9b2 are extended to the other surface 9f which is the third side surface.

The offset portion 9b is constituted so that a user holds the offset portion 9b with his (her) hand(s) and is capable of raising the image forming apparatus 1. Specifically, as shown in part (b) of FIG. 2, the third surface 9b2 of the offset portion 9b on an upper side with respect to the vertical direction is provided with a handle portion 9c held by the user with his (her) hand(s) when the user raises the image forming apparatus 1. The handle portion 9c is a recessed portion recessed upward with respect to the vertical direction at the third surface 9b2 of the offset portion 9b. Further, the third surface 9b2 of the offset portion 9b is provided with an air communication port 9d penetrating the outer casing cover 9. Each of the right side surface 9a which is the first surface, and the second surface 9b1 and the third surface 9b2 is a flat surface, but at least one surface thereof may only be required to be the flat surface. Of the second surface 9b1 and the third surface 9b2, the surface where the handle portion 9c is provided may preferably be the flat surface.

As shown in FIG. 3, inside the image forming apparatus 1, a heat generating unit 13 which is a heat generating member (element) and an air blowing machine 14 for sucking the outside air into the inside of the image forming apparatus 1 are provided. The air blowing machine 14 is an air blower for blowing (supplying) the air to the heat generating unit 13 which is the heat generating member disposed inside the image forming apparatus 1. Further, the air blowing machine 14 is the air blower for blowing the air to cartridges P as objects requiring cooling. The heat generating unit 13 which is the heat generating member and the air blowing machine 14 are provided on a side of the right side plate 5 which is one of the frame members. Specifically, the heat generating unit 13 which is the heat generating member and the air blowing machine 14 are disposed between the right side plate 5 and the outer casing cover 9 (FIG. 1). The air blowing machine 14 supplies the air to the cartridges P from the right side plate 5 side toward the left side plate 4 side. Further, on a side which is an outer right side of the right side plate 5 and which an inside of the outer casing cover 9 (FIG. 1), a duct 15 constituting an air blowing passage through which the air sucked through the air communication port 9d is supplied to a space between the right side plate 5 and the left side plate 4 is provided (FIG. 4). On a bottom side of the duct 15, a connecting portion 15a connecting the duct 15 with the air communication port 9d provided in the outer casing cover 9. On a top surface side of the duct 15, the air blowing machine 14 for sucking the outside air into the inside of the image forming apparatus 1 through the air communication port 9d is provided. The air blowing machine 14 is connected to the top surface side of the duct 15. Inside the duct 15, the heat generating unit 13 is provided. That is, the heat generating unit 13 is provided inside the duct 15 and is covered with the duct 15. The heat generating unit 13 is disposed inside the duct 15 between the air blowing machine 14 connected to the top surface side of the duct 15 and the air communication port 9d connected to the connecting portion 15a on the bottom side of the duct 15.

As shown in FIG. 4, the right side plate 5 is provided with an opening 5a through which the air sucked through the air communication port 9d by the air blowing machine 14 connected to the duct 15 is to be supplied to the image forming area 6. The left side plate 4 opposing the right side plate 5 is provided with an opening 4a through which the air supplied to the image forming air 6 through the opening 5a of the right side plate 5 is to be supplied to a space between the left side plate 4 and the outer casing cover 8 provided on an outer left side of the left side plate 4. The opening 4a provided in the left side plate 4 and the opening 5a provided in the right side plate 5 are openings penetrating the side plates 4 and 5 toward a space between the side plates 4 and 5. As regards the image forming apparatus 1 according to this embodiment, the image forming area 6 between the left side plate 4 and the right side plate 5 is enclosed by a wall surface including the side plates 4 and 5, and therefore, is constituted so that the air taken in the image forming area 6 through the opening 5a of the right side plate 5 is discharged through the opening 4a of the left side plate 4.

Next, a flow of the air in the image forming apparatus 1 according to this embodiment will be described using FIG. 4. Incidentally, arrows shown in FIG. 4 represent an air passage which is the flow of the air discharged through the air communication port 8d via the image forming area. In the image forming apparatus 1 according to this embodiment, the air communication port 9d provided at the offset portion 9b of the outer casing cover 9 is used as an air suction port for permitting suction of the air from the outside to the inside of the image forming apparatus 1. Further, the air communication port 8d provided at the offset portion 8b of the outer casing cover 8 is used as an air discharge port for permitting discharge of the air from the inside to the outside of the image forming apparatus 1.

As shown in FIG. 4, the air blowing machine 14 provided inside the image forming apparatus 1 operates, so that the air outside the image forming apparatus 1 is sucked into the image forming apparatus 1 through the air communication port (air suction port) 9d provided at the offset portion 9b of the outer casing cover 9. The sucked air is supplied to the inside of the duct 15 through the connecting portion 15a provided on the duct 15.

The air sucked inside the duct 15 is sucked by the air blowing machine 14 via the heat generating unit 13 disposed inside the duct 15. At this time, the heat generating unit 13 is cooled by the air flowing through the inside of the duct 15.

The air supplied from the air blowing machine 14 is supplied to the image forming area 6 through the opening 5a provided in the right side plate 5 and thereafter is supplied to the outer left side of the left side plate 4 through the opening 4a provided in the left side plate 4. The air supplied to the outer left side of the left side plate 4 through the opening 4a provided in the left side plate 4 flows between the left side plate 4 and the outer casing cover 8 and passes through the air communication port (air discharge port) 8d provided at the offset portion 8b of the left side surface 8a and thus is discharged to the outside of the image forming apparatus 1.

By continuously supplying the air along the air passage as described above, the image forming apparatus 1 of this embodiment is capable of cooling the heat generating member provided inside the image forming apparatus 1.

Next, by using FIG. 5, the air communication ports in the case where the image forming apparatus 1 according to this embodiment is disposed against the wall will be described. Incidentally, arrows shown in FIG. 5 represent an air passage which is a flow of the air which is sucked through the air communication port 9d along the offset portion 9b and which is discharged along the offset portion 8b through the air communication port 8d via the image forming area.

A state shown in FIG. 5 is a state such that the image forming apparatus 1 according to this embodiment is disposed against the wall so that the right side surface 9a of the outer casing cover 9 and the left side surface 9*a* of the outer casing cover 8 contact the wall surfaces 20 and 20 at placement places. Also, in such a state, as regards the image forming apparatus 1 according to this embodiment, a gap (air communication passage) through which the air is capable of flowing in the front-rear direction which is the second direction is formed between the offset portion 9*b* and the wall surface 20 by the offset portion 9*b* provided at the bottom of the outer casing cover 9 and between the offset portion 8*b* and the wall surface 20 by the offset portion 8*b* provided at the bottom of the outer casing cover 8.

Each of the gap formed by the offset portion 8*b* between the wall surface 20 and the left side plate 8*a* facing one side of the first direction and the gap formed by the offset portion 9*b* between the wall surface 20 and the right side plate 9*a* facing the other side of the first direction is extended to one surface 8*e* (or 9*e*) and to the other surface 8*f* (or 9*e*) with respect to the second direction perpendicular to the first direction. For this reason, the gap formed with respect to the second direction between the offset portion 9*b* of the outer casing cover 9 and the wall surface 20 can be used as an air suction passage 17. Further, the gap formed with respect to the second direction between the offset portion 8*b* of the outer casing cover 8 and the wall surface 20 can be used as an air discharge passage 16.

The air suction passage 17 and the air discharge passage 16 are formed as described above, so that the image forming apparatus 1 of this embodiment is capable of ensuring the air communication passages through which the air for cooling the heat generating member provided inside the image forming apparatus 1 is taken in and discharged, i.e., is flowable (communicatable) even in a state in which the image forming apparatus 1 is provided against the wall so that the right side surface 9*a* of the outer casing cover 9 contacts the wall surface 20 and so that the left side surface 8*a* of the outer casing cover 8 contacts the wall surface 20.

As described above, according to this embodiment, at the side surfaces 8*a* and 9*a* of the outer casing covers 8 and 9 facing one side and the other side, respectively, of the first direction, the offset portions 8*b* and 9*b* are provided and extended to one surfaces 8*e* and 9*e* and to the other surfaces 8*f* and 9*f* with respect to the second direction perpendicular to the first direction, and are provided with the air communication ports 8*d* and 9*d*, respectively, and with the handle portions 8*c* and 9*c*, respectively. By this, while preventing upsizing of the image forming apparatus due to provision of the projection on the image forming apparatus side and preventing a lowering in design property, it is possible to ensure the air communication passages through which the air is flowable (communicatable) through the air communication ports 8*d* and 9*d* even when the image forming apparatus 1 is provided against the wall.

Other Embodiments

In the above-described embodiment, the offset portion 8*b* is provided and extended to one surface 8*e* and the other surface 8*f* with respect to the second direction at the left side surface 8*a* of the image forming apparatus 1, and the offset portion 9*b* is provided and extended to one surface 9*e* and the other surface 9*f* with respect to the second direction at the right side surface 9*a* of the image forming apparatus 1, but the present invention is not limited thereto. As shown in part (a) of FIG. 6, a constitution in which the offset portions 8*b* and 9*b* are extended to the one surfaces 8*e* and 9*e* with respect to the second direction at the side surfaces 8*a* and 9*a* of the image forming apparatus 1 may also be employed. Or, although not illustrated, a constitution in which each of the offset portions is extended to the other side surface with respect to the second direction at the associated side surface of the image forming apparatus 1 may also be employed. That is, the constitution in which the offset portion is extended to one surface or the other surface with respect to the second direction, perpendicular to the first direction, at the side surface facing one side or the other side of the first direction of the image forming apparatus may also be employed.

Further, in the above-described embodiment, as shown in parts (a) and (b) of FIG. 2, the offset portions 8*b* and 9*b* were disposed at the bottoms of the outer casing cover 8 and 9 with respect to the vertical direction, but the present invention is not limited thereto. As shown in part (b) of FIG. 6, a constitution in which the offset portions 8*b* and 9*b* are provided at central portions of the outer casing covers 8 and 9, respectively, with respect to the vertical direction may also be employed.

Further, in the above-described embodiment, as shown in FIGS. 3 and 4, the constitution in which the heat generating unit 13 which is the heat generating member is disposed between the air blowing machine 14 and the air communication port 9*d* was described as an example, but the present invention is not limited thereto. As shown in FIGS. 7 and 8, a constitution in which the air blowing machine 14 is disposed between the air communication port 9*d* and the heat generating unit 13 which is the heat generating member may also be employed. Incidentally, arrows shown in FIG. 8 represent an air passage which is a flow of the air which is sucked through the air communication port 9*d* and which is supplied to the opening 5*a* of the right side plate 5 via the heat generating unit 13.

Further, in the above-described embodiment, the heat generating unit was disposed on the right side which is the one frame member side of the image forming apparatus, and the right-side air communication port was used as the air suction port and the left-side air communication port was used as the air discharge port, but the present invention is not limited thereto. A constitution in which the heat generating unit is disposed on the left side which is the other frame member side of the image forming apparatus and in which the left-side air communication port is used as the air suction port and the right-side air communication port is used as the air discharge port may also be employed. Further, in the above-described embodiment, the air communication port on one frame member side of the image forming apparatus in which the heat generating member was provided was used as the air suction port, and the air communication port on the other frame member side opposing the one frame member side was used as the air discharge port, but the present invention is not limited thereto. A constitution in which the air communication port on the one frame member side of the image forming apparatus in which the heat generating member is provided is used as the air discharge port and in which the air communication port on the other frame member side opposing the one frame member side is used as the air suction portion may also be employed. Further, a constitution in which the air blowing machine was provided on the one frame member side of the image forming apparatus was described as an example, but a constitution in which the air blowing machine is provided on both the one frame member side and the other frame member side opposing the one frame member side may also be employed. Further, a constitution in which the air blowing machine was provided on the air suction side was described as an example, but a constitution in which the air blowing machine is provided on the air discharge side may also be employed.

Further, in the above-described embodiment, as the image forming apparatus, the printer was described as an example, but the present invention is not limited thereto. For example, other image forming apparatuses such as a copying machine, a facsimile machine and a multi-function machine having functions of these machines in combination may also be used. By applying the present invention to these image forming apparatuses, a similar effect can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-181251 filed on Oct. 1, 2019, which is hereby incorporated by reference herein in its entirety.

What is claimed is:

1. An image forming apparatus comprising:

a frame member of said image forming apparatus;

an outer casing covering an outside of the frame member of said image forming apparatus;

a duct provided between the frame member and the outer casing;

an air blower provided between the frame member and the outer casing and configured to take an air from an outside and cool an inside of the image forming apparatus; and a heat generating member provided inside of the duct;

wherein the outer casing is provided with an opposing surface extending horizontally so as to oppose an installation surface thereof in a position separated from the installation surface, wherein the opposing surface includes an opening, and wherein the duct and the air blower are positioned at an upper side of the opposing surface.

2. An image forming apparatus according to claim 1, wherein said opposing surface includes a grip portion.

3. An image forming apparatus according to claim 1, wherein said opposing surface includes a recessed portion recessed upward with respect to a vertical direction.

4. An image forming apparatus according to claim 1, wherein the air blower is disposed above the heat generating member and takes the air from an outside through the opening.

5. An image forming apparatus according to claim 1, wherein said air blower is provided between said heat generating member and said opening.

6. An image forming apparatus according to claim 1, wherein said second surface portion and said third surface portion are provided at a bottom of said outer casing with respect to a vertical direction.

7. An image forming apparatus according to claim 1, wherein said second surface portion and said third surface portion are provided at a central portion of said outer casing with respect to a vertical direction.

8. An image forming apparatus according to claim 1, wherein said frame member includes a first frame member provided on one side with respect to the horizontal direction and a second frame member provided on the other side with respect to the horizontal direction so as to oppose said first frame member through a space.

* * * * *